US008766856B2

(12) United States Patent
Hsieh et al.

(10) Patent No.: US 8,766,856 B2
(45) Date of Patent: Jul. 1, 2014

(54) WIDEBAND ANTENNA

(75) Inventors: Chih-Sen Hsieh, Hsinchu (TW); Jen-Min Shau, Hsinchu (TW); Hsiao-Yi Lin, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 293 days.

(21) Appl. No.: 13/210,378

(22) Filed: Aug. 16, 2011

(65) Prior Publication Data

US 2012/0299780 A1 Nov. 29, 2012

(30) Foreign Application Priority Data

May 25, 2011 (TW) ..... 100118328 A

(51) Int. Cl.
*H01Q 1/38* (2006.01)

(52) U.S. Cl.
USPC ..... 343/700 MS

(58) Field of Classification Search
CPC ..... H01Q 1/38; H01Q 9/0407; H01Q 9/0421; H01Q 1/243; H01Q 5/0003
USPC ..... 343/700 MS, 702, 866; 455/90
See application file for complete search history.

(56) References Cited

U.S. PATENT DOCUMENTS

| | | | | |
|---|---|---|---|---|
| 6,252,554 | B1 * | 6/2001 | Isohatala et al. | 343/700 MS |
| 6,529,168 | B2 * | 3/2003 | Mikkola et al. | 343/702 |
| 7,109,928 | B1 * | 9/2006 | Thiele et al. | 343/700 MS |
| 7,417,588 | B2 * | 8/2008 | Castany et al. | 343/700 MS |
| 2003/0146878 | A1 * | 8/2003 | Mikkola et al. | 343/702 |
| 2004/0145527 | A1 * | 7/2004 | Mikkola | 343/700 MS |
| 2007/0146212 | A1 * | 6/2007 | Ozden et al. | 343/702 |
| 2009/0002243 | A1 * | 1/2009 | Dahlstrom et al. | 343/702 |

* cited by examiner

*Primary Examiner* — Huedung Mancuso
(74) *Attorney, Agent, or Firm* — Winston Hsu; Scott Margo

(57) ABSTRACT

A wideband antenna includes a grounding element electrically connected to a ground, a radiating element, a matching adjustment element electrically connected to the radiating element, a feed-in element electrically connected between the matching adjustment element and the grounding element for receiving feed-in signals, and a shorting element electrically connected between the matching adjustment element and the grounding element. A width of the matching adjustment element is related to a bandwidth of the wideband antenna.

4 Claims, 7 Drawing Sheets

WIDEBAND ANTENNA

BACKGROUND OF THE INVENTION

1. Field of the Invention

The present invention relates to a wideband antenna, and more particularly, to a wideband antenna increasing antenna bandwidth via a matching adjustment element.

2. Description of the Prior Art

An antenna is used for transmitting or receiving radio waves, to communicate or exchange wireless signals. An electronic product with wireless communication function, such as a laptop, a personal digital assistant (PDA), etc., usually accesses a wireless network through a built-in antenna. Therefore, for facilitating a user to access the wireless communication network, an ideal antenna should have a wide bandwidth and a small size to meet the trend of compact electronic products, so as to integrate the antenna into a portable wireless communication equipment. In addition, an ideal antenna should cover different frequency bands required for different wireless communication networks.

In the prior art, one of the common antennas for wireless communication is a planar inverted F antenna (PIFA), as implied by the name, whose shape is similar to a rotated and inverted "F". However, a bandwidth and bandwidth percentage of the PIFA are not good enough especially in low frequency band, and thus its application range is limited. Therefore, how to improve antenna bandwidth effectively to apply to wireless communication systems with wide frequency band such as long term evolution (LTE) has become a goal of the industry.

SUMMARY OF THE INVENTION

It is therefore an object to provide a wideband antenna.

The present invention discloses a wideband antenna including a grounding element electrically connected to a ground, a radiating element, a matching adjustment element, electrically connected to the radiating element, a feed-in element, electrically connected between the matching adjustment element and the grounding element, for receiving feed-in signals, and a shorting element, electrically connected between the matching adjustment element and the grounding element, wherein a width of the matching adjustment element relates to a bandwidth of the wideband antenna.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
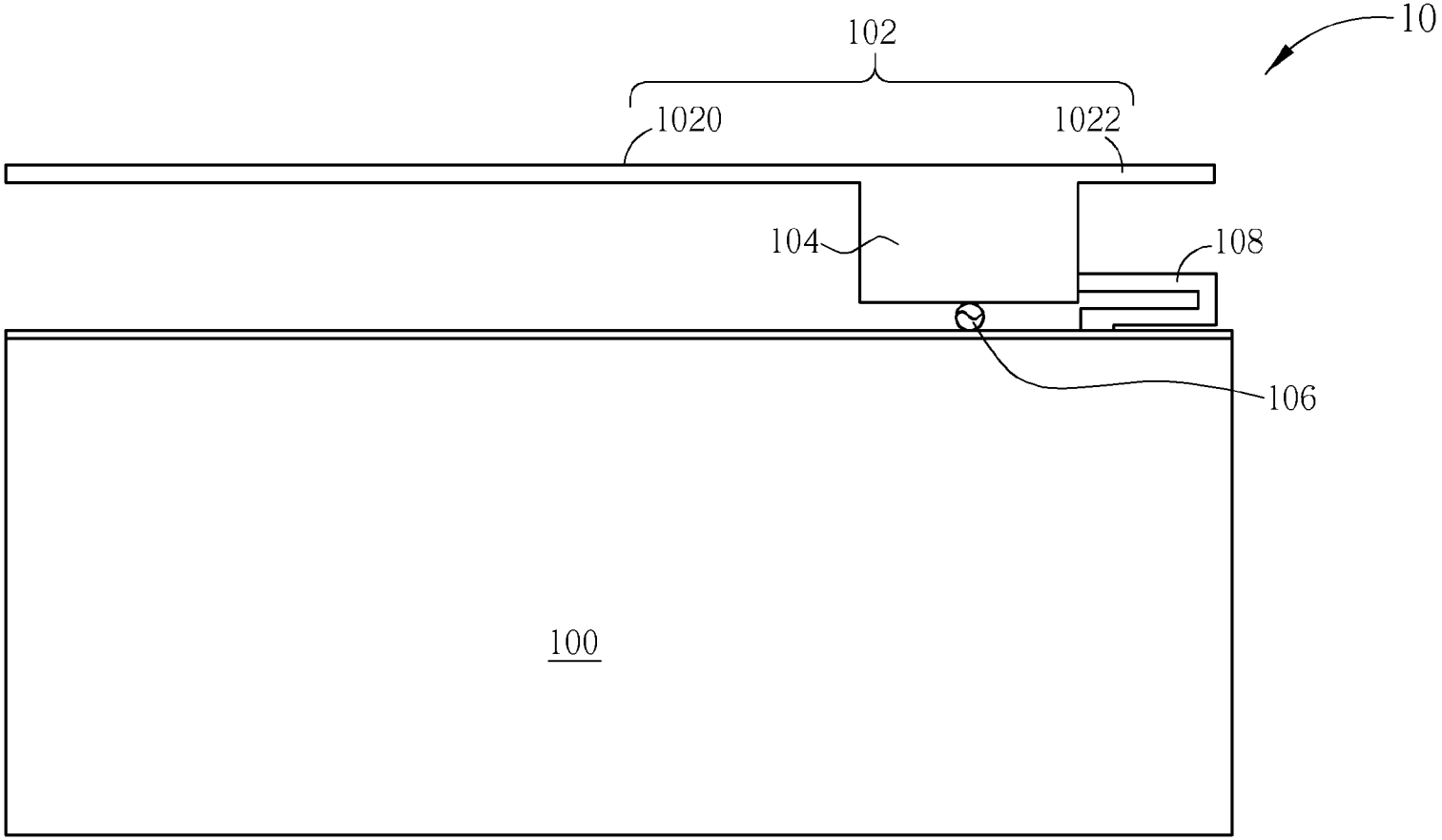
FIG. 1 is a schematic diagram of a wideband antenna according to an embodiment of the present invention.

Please refer to FIG. 1, which is a schematic diagram of a wideband antenna 10 according an embodiment of the present invention. The wideband antenna 10 includes a grounding element 100, a radiating element 102, a matching adjustment element 104, a feed-in element 106 and a shorting element 108. The grounding element 100 is electrically connected to a ground for providing grounding. The radiating element 102 is composed of a first radiator 1020 and a second radiator 1022. The first radiator 1020 and the second radiator 1022 extend along different directions and have different lengths, for providing two different radiation frequency bands. One terminal of the matching adjustment element 104 is electrically connected to a cross of the first radiator 1020 and the second radiator 1022, and another terminal of the matching adjustment element 104 is electrically connected to the feed-in element 106. The feed-in element 106 is electrically connected between the matching adjustment element 104 and the grounding element 100, for receiving feed-in signals. That is, when transmitting signals, the feed-in element 106 receives the feed-in signals from a radio frequency (RF) process module, and transmits the feed-in signals to the radiating element 102 via the matching adjustment element 104, to perform radio transmission; when receiving signals, wireless signals inducted by the radiating element 102 are transmitted to the RF process module through the matching adjustment element 104 and the feed-in element 106. Furthermore, the shorting element 108 conforms to a meander shape, for providing a current path from the matching adjustment element 104 to the grounding element 100, to keep normal operations of radiation effect.

On the other hand, the matching adjustment element 104 connects the feed-in element 106 and the radiating element 102, and more importantly, a width of the matching adjustment element 104 relates to a bandwidth of the wideband antenna 10. That is, when designing the wideband antenna 10, a designer can adjust the width of the matching adjustment element 104 according to required bandwidth, so as to achieve wideband operations. In addition, a position of the matching adjustment element 104 relates to a frequency band of the wideband antenna 10 as well. In other words, via adjusting the width and the position of the matching adjustment element 104, the wideband antenna 10 can have wideband performance within desire frequency band.

Figure 2:
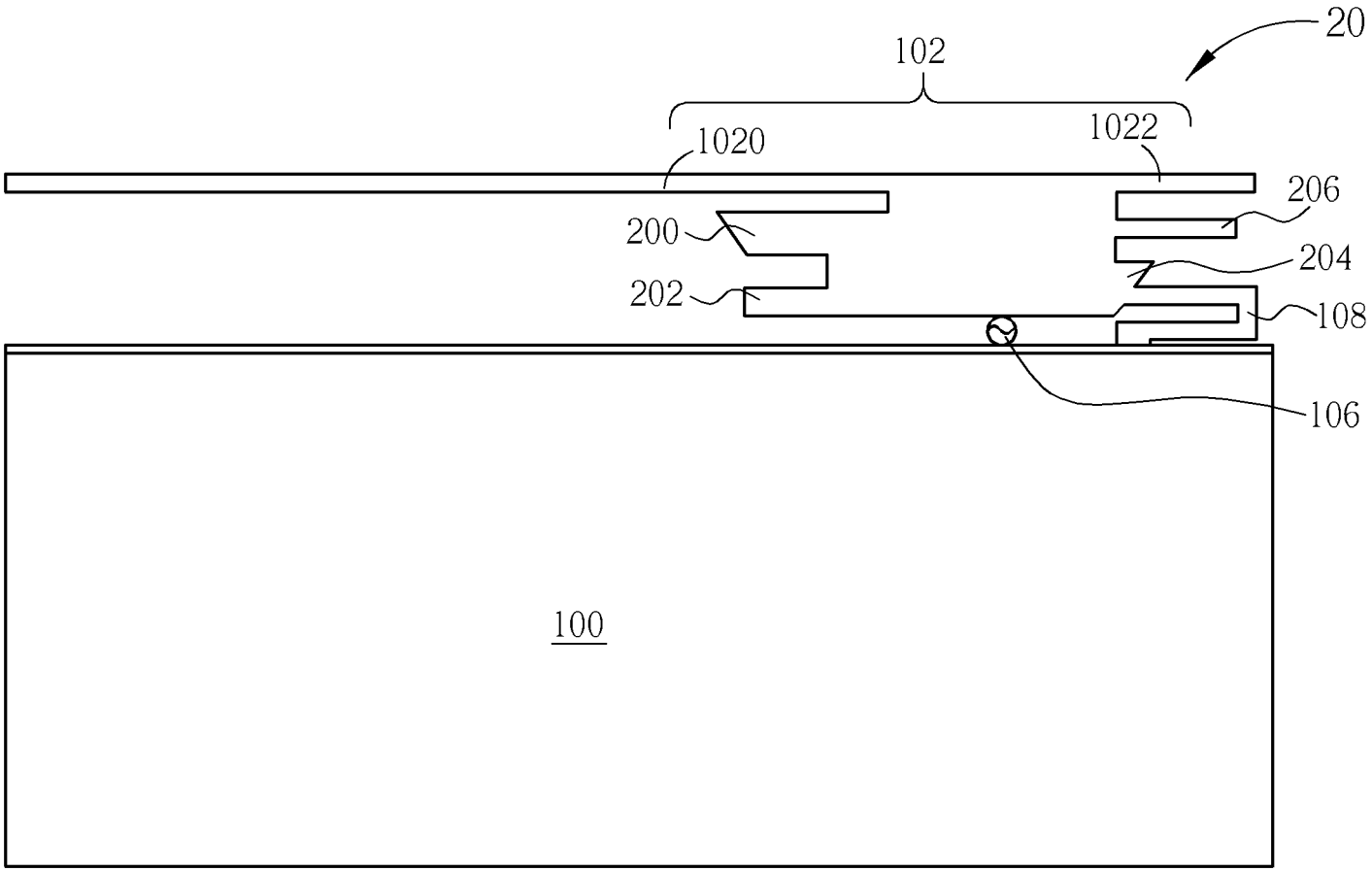
FIG. 2 is a schematic diagram of a wideband antenna according to an embodiment of the present invention.
Figure 3:
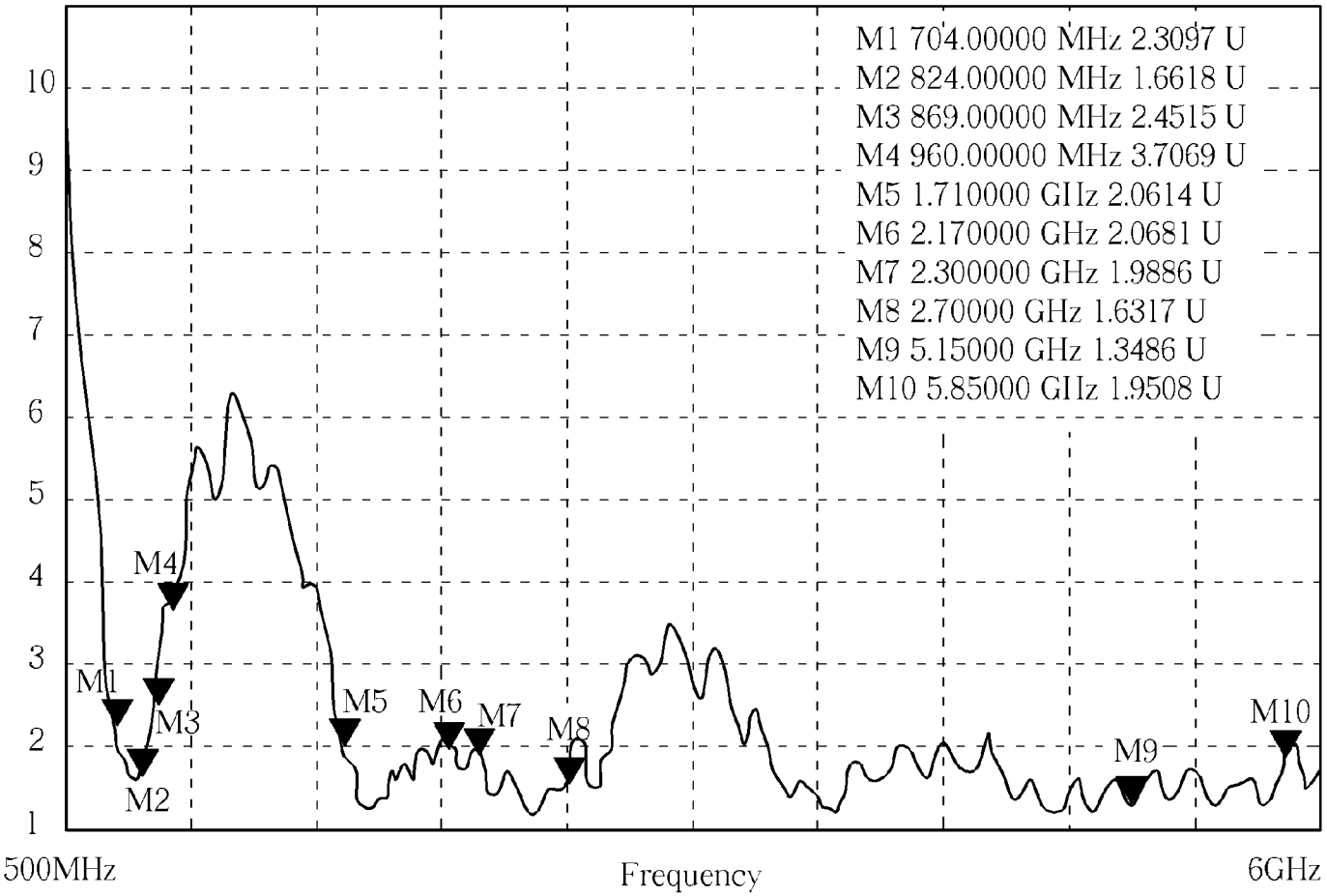
FIG. 3 is a schematic diagram of VSWR of the wideband antenna shown in FIG. 2.
Figure 4:
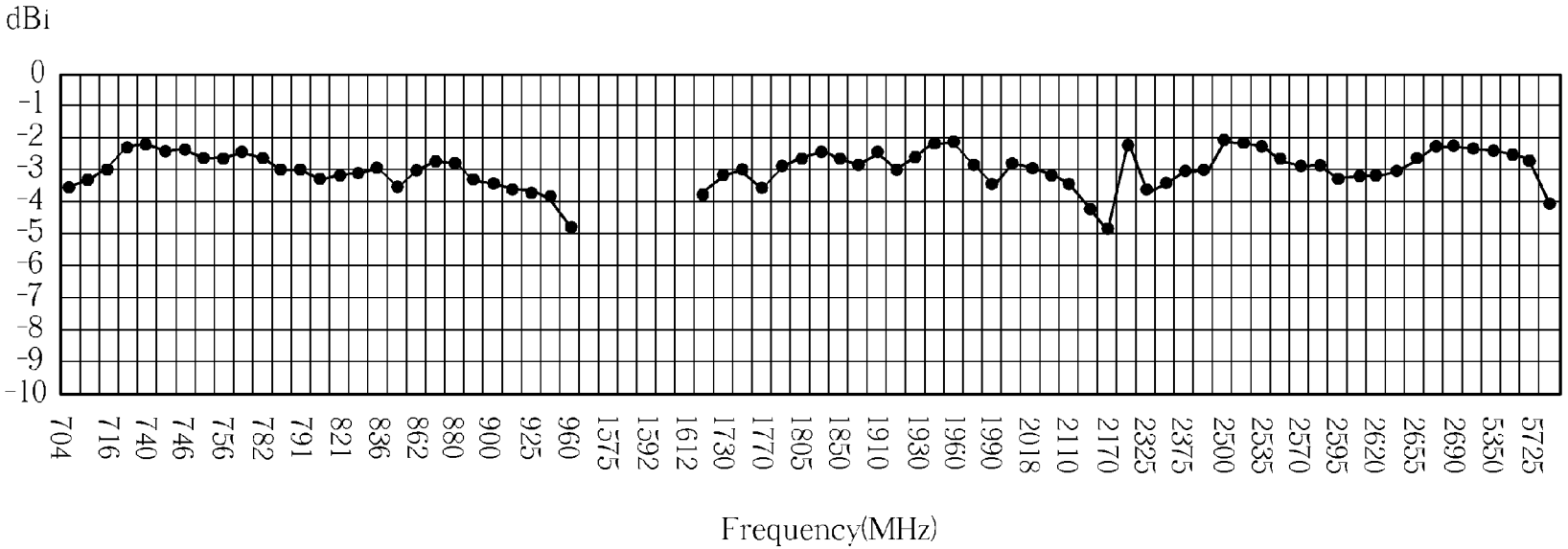
FIG. 4 is a schematic diagram of antenna gain of the wideband antenna shown in FIG. 2.

Moreover, in order to improve the bandwidth, the present invention can further add an auxiliary radiating element in the wideband antenna 10. For example, please refer to FIG. 2, which is a schematic diagram of a wideband antenna 20 according to an embodiment of the present invention. Structures of the wideband antenna 20 and the wideband antenna 10 are similar, and thus same elements are denoted by same symbols. Difference between the wideband antenna 20 and wideband antenna 10 is that the wideband antenna 20 adds auxiliary radiating elements 200, 202, 204 and 206 extending outward from the matching adjustment element 104, to increase current paths as well as extend bandwidth. Please continue to refer to FIG. 3, which is a schematic diagram of voltage standing wave ratio (VSWR) of the wideband antenna 20. As shown in FIG. 3, regarding VSWR=3.5 as a basis, a low frequency bandwidth of the wideband antenna 20 is substantially 270 MHz. If a center frequency of the low frequency is 825 MHz, a percentage of the low frequency bandwidth of the wideband antenna 20 is substantially 32.7%, which is an advantage of the low frequency bandwidth. Furthermore, please refer to FIG. 4, which is a schematic diagram of an antenna gain of the wideband antenna 20. As shown in FIG. 4, an antenna efficiency of the wideband antenna 20 is greater than 40% bandwidth, and the percentage of the low frequency bandwidth is greater than 30%, while a percentage of a high frequency bandwidth is greater than 40%.

Figure 5:
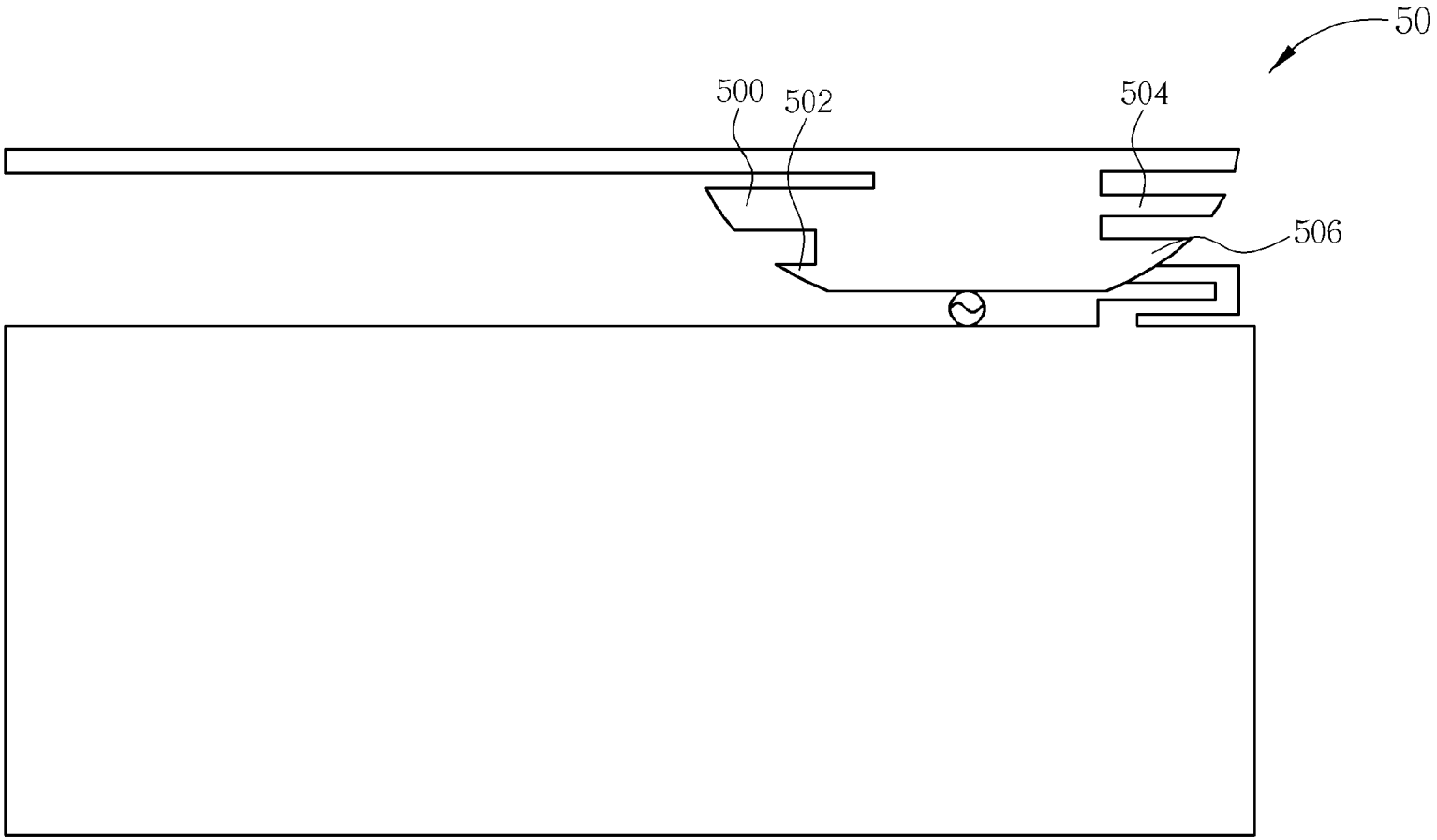
FIG. 5 is a schematic diagram of a wideband antenna according to an embodiment of the present invention.

Noticeably, the present invention is through adjusting characteristics such as the position and the shape of the matching adjustment element 104, to adjust frequency bands of the wideband antenna 10 or 20, so as to achieve wideband, and modifications or alterations can be made according to above description. For example, in FIG. 2, the auxiliary radiating elements 200, 202, 204 and 206 are utilized for increasing current paths, while positions, sizes and numbers of the auxiliary radiating element 200, 202, 204 and 206 are not limited. For example, FIG. 5 is a schematic diagram of a wideband antenna 50 according to an embodiment of the present invention. Structures of the wideband antenna 50 and the wideband antenna 20 shown in FIG. 2 are similar, while shapes of auxiliary radiating elements 500, 502, 504, 506 and the auxiliary radiating elements 200, 202, 204 and 206 of the wideband antenna 20 are different.

Figure 6:
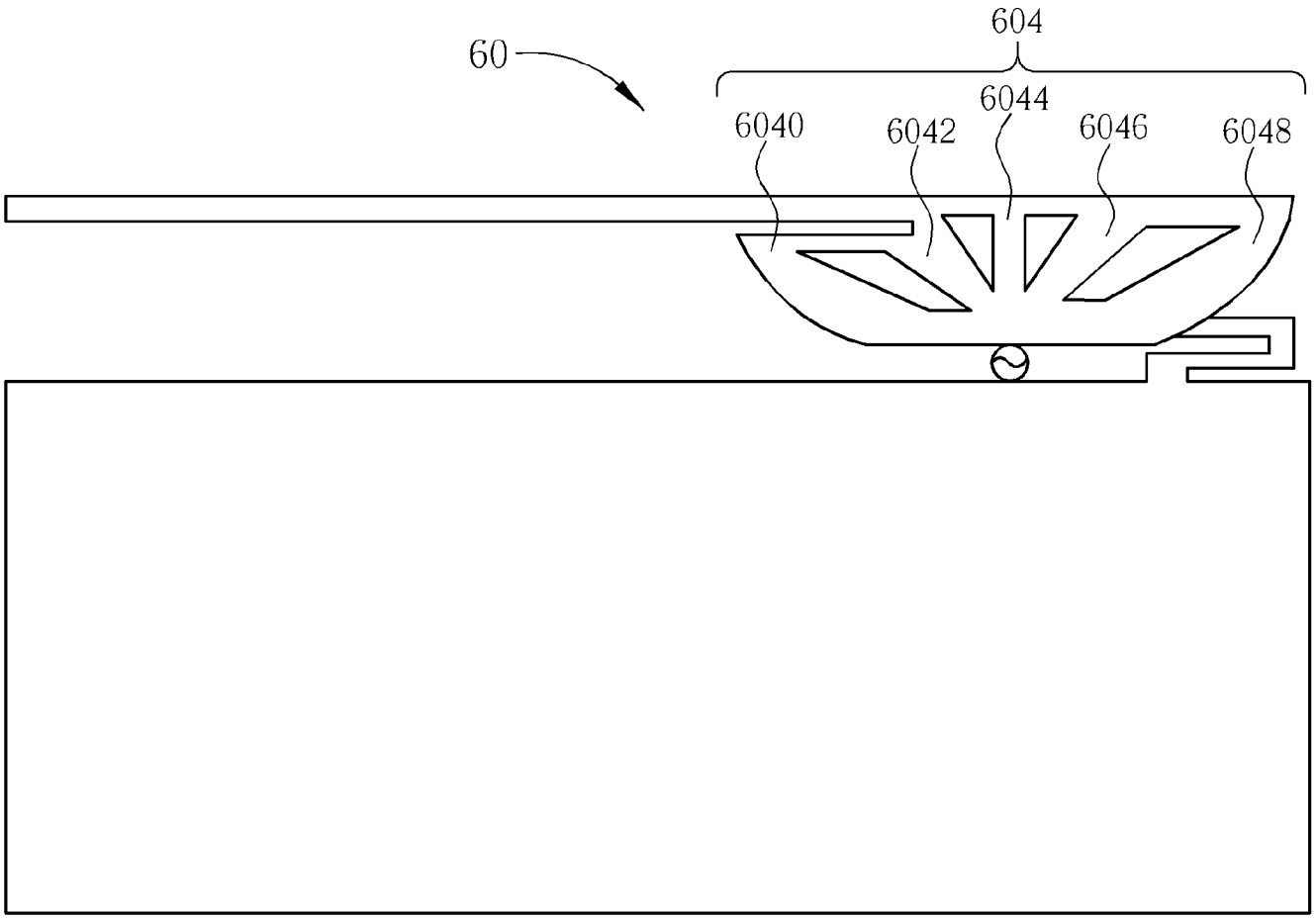
FIG. 6 is a schematic diagram of a wideband antenna according to an embodiment of the present invention.

Besides, methods of adjusting width or shape of the matching adjustment element 104 are not limited. For example, FIG. 6 is a schematic diagram of a wideband antenna 60 according to an embodiment of the present invention. Structures of the wideband antenna 60 and the wideband antenna 10 shown in FIG. 1 are similar, while a matching adjustment element 604 is composed of pillars 6040, 6042, 6044, 6046 and 6048, which can achieve wideband as well.

Figure 7:
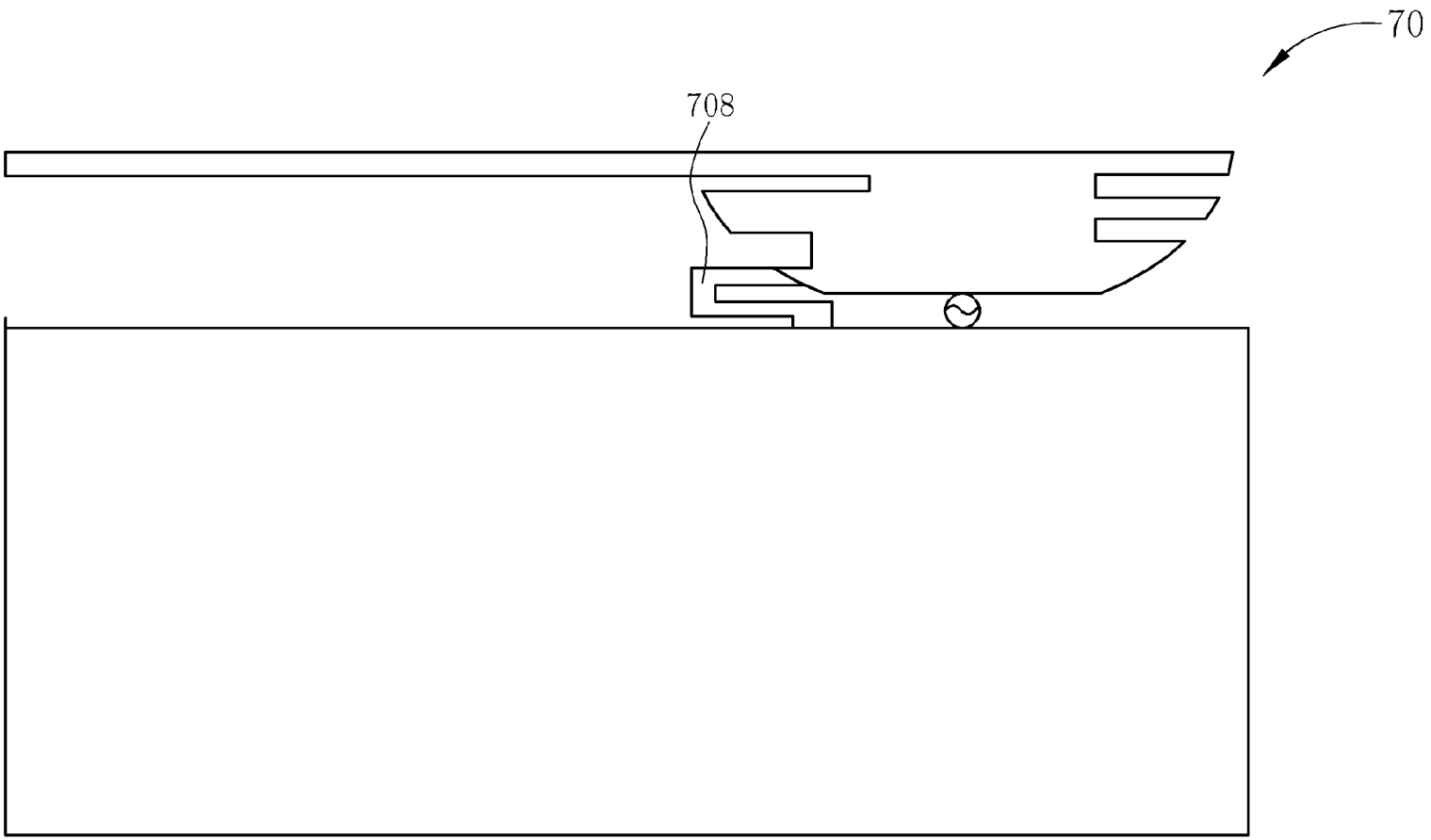
FIG. 7 is a schematic diagram of a wideband antenna according to an embodiment of the present invention.

On the other hand, in the present invention, the shorting element 108 is utilized for providing a current path from the matching adjustment element 104 to the grounding element 100, which is not limited to be disposed close to a high frequency side, i.e. the second radiator 1022 side. For example, FIG. 7 is a schematic diagram of a wideband antenna 70 according to an embodiment of the present invention. Structures of the wideband antenna 70 and the wideband antenna 50 shown in FIG. 5 are similar, while a shorting element 708 of the wideband antenna 70 is moved from the high frequency side to the low frequency side, which can achieve wideband as well.

Above embodiments are based on dual-band application such as wireless local area network (WLAN) and long term evolution (LTE), and thus the radiating element 102 is composed of two main radiators, but not limited to this, those skilled in the art should make modifications according the system requirements, to properly adjust characteristics such as material and shape of the radiating element 102.

To sum up, the present invention is to increase antenna bandwidth especially in low frequency via the matching adjustment element, to meet the need of wideband of a wireless communication system.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A wideband antenna, comprising:

a grounding element, electrically connected to a ground;

a radiating element;

a matching adjustment element, electrically connected to the radiating element, comprising:

a plurality of branches, electrically connected between the radiating element and the feed-in element, wherein a total width of the plurality of branches is related to the bandwidth of the wideband antenna;

a feed-in element, electrically connected between the matching adjustment element and the grounding element, for receiving feed-in signals; and a shorting element, electrically connected between the matching adjustment element and the grounding element;

wherein a width of the matching adjustment element is related to a bandwidth of the wideband antenna.

2. The wideband antenna of claim 1, wherein the radiating element comprises:

a first radiator, extending along a first direction; and a second radiator, electrically connected to the first radiator, and extending along an opposite direction of the first direction;

wherein the matching adjustment element is electrically connected between the first radiator and the second radiator.

3. The wideband antenna of claim 1, further comprising at least an auxiliary radiating element, electrically connected to the matching adjustment element, for improving the bandwidth of the wideband antenna.

4. The wideband antenna of claim 1, wherein the shorting element conforms to a meander shape.

* * * * *